US007070354B1

(12) United States Patent
Gutierrez-Caro

(10) Patent No.: US 7,070,354 B1
(45) Date of Patent: Jul. 4, 2006

(54) POWER OPERABLE DISPENSING TOOTHBRUSH

(76) Inventor: Gustavo Gutierrez-Caro, 7301 SW. 139th Ave., Miami, FL (US) 33183

( * ) Notice: Subject to any disclaimer, the term of this patent is extended or adjusted under 35 U.S.C. 154(b) by 71 days.

(21) Appl. No.: 10/985,813

(22) Filed: Nov. 10, 2004

(51) Int. Cl.
*A46B 11/04* (2006.01)

(52) U.S. Cl. ..... 401/277; 401/270; 401/268; 401/175; 401/172; 401/171; 401/174

(58) Field of Classification Search ..... 401/277, 401/270, 171–175, 268; 15/22.1
See application file for complete search history.

(56) References Cited

U.S. PATENT DOCUMENTS

| | | | | |
|---|---|---|---|---|
| 2,699,889 | A | 1/1955 | Johnson | |
| 3,088,148 | A * | 5/1963 | Moret | 15/22.1 |
| 3,104,405 | A * | 9/1963 | Perrinjaquet | 15/22.1 |
| 3,369,265 | A * | 2/1968 | Halberstadt et al. | 15/22.1 |
| 4,122,983 | A | 10/1978 | Jolly | |
| 4,288,169 | A | 9/1981 | McMenamin, IV | |
| 4,421,433 | A | 12/1983 | Villanueva | |
| 4,811,445 | A * | 3/1989 | Lagieski et al. | 401/268 |
| 5,100,252 | A | 3/1992 | Podolsky | |
| D419,775 | S | 2/2000 | Sidhu | |
| 6,434,773 | B1 | 8/2002 | Kuo | |
| 6,785,926 | B1 * | 9/2004 | Green | 15/22.1 |
| 6,957,925 | B1 * | 10/2005 | Jacobs et al. | 401/270 |
| 2001/0016697 | A1 * | 8/2001 | Gorsen | 601/80 |
| 2001/0040173 | A1 * | 11/2001 | Yamamoto et al. | 401/183 |
| 2002/0162180 | A1 * | 11/2002 | Blaustein et al. | 15/22.1 |
| 2004/0237226 | A1 * | 12/2004 | Hohlbein et al. | 15/22.1 |
| 2005/0286967 | A1 * | 12/2005 | Blauzdys | 401/281 |

* cited by examiner

*Primary Examiner*—Khoa D. Huynh

(57) ABSTRACT

A hand-operable toothbrush for selectively dispensing dentifrice that includes a proximal section defining a reservoir and a distal section defining a bristle section including a mechanism for engaging the proximal section. The bristle section includes a head portion including a plurality of spaced bristles and a power mechanism for vibrating same. The toothbrush also includes a dispensing mechanism for manually adjusting a volume of the reservoir and thereby causing dentifrice to dissipate outwardly from the reservoir and head portion as needed. The dispensing mechanism includes a gasket engaged with the distal section and a snap ring positioned within the reservoir. The dispensing mechanism and the power mechanism are independently operable.

9 Claims, 4 Drawing Sheets

POWER OPERABLE DISPENSING TOOTHBRUSH

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

TECHNICAL FIELD

This invention relates to a toothbrush and, more particularly, to a power operable dispensing toothbrush for selectively dispensing dentifrice as desired by a user.

PRIOR ART

The use of self-dispensing toothbrushes is well known in the prior art. These prior art devices, due to their many limitations and deficiencies, do not have a practical and commercial value. For example, many dispensing devices have such a small bore or conduit through which contents are supposed to flow that it is very doubtful if any contents are dispensed at all at its discharge point.

Most, if not all prior devices, are highly unsanitary and untidy due to system design and construction wherein the heads of the brush become contaminated, but are not replaceable. It is well known that toothbrush bristles should be replaced on a regular basis since bristles harbor germs after a period of use. While the entire toothbrush can be replaced, it is more economical to replace only the brush elements. For ease of replacement, it is desirable to have a snap-on feature for self-locating the replaceable bristle elements on the brush head.

For the convenience of portability, it is desirable to have a self contained, dentifrice dispensing electrical toothbrush for brushing anywhere at anytime. This would save packing space during periods of travel, and would also keep the bathroom at home tidier by eliminating the presence of a messy toothpaste tube spilling everywhere.

Accordingly, a need remains for a power operable dispensing toothbrush that would overcome the above-noted shortcomings. The present invention satisfies such a need by providing a toothbrush that is compact in design, has a two-in-one design, and is convenient to use. Such a toothbrush features a removable/replaceable bristle portion and a sufficient dispensing mechanism, ensuring proper function at all times.

BRIEF SUMMARY OF THE INVENTION

In view of the foregoing background, it is therefore an object of the present invention to provide a power operable dispensing toothbrush. These and other objects, features, and advantages of the invention are provided by a hand-operable toothbrush for selectively dispensing dentifrice as desired by a user.

The toothbrush includes a proximal section having a centrally disposed longitudinal axis and defining a reservoir axially disposed along a partial length thereof. Such a reservoir has oppositely spaced top and bottom end portions.

The present invention also includes a distal section defining a bristle section. Such a distal section includes a mechanism for removably engaging the proximal section and a head portion oppositely spaced from the engaging mechanism. A plurality of randomly spaced bristles are selectively engageable with a user's teeth.

The engaging mechanism includes a flange portion pivotally connected to the top end portion of the proximal section. The distal section is provided with a corresponding notch sized and shaped for receiving the flange portion therein, advantageously maintaining the distal and proximal sections at locked positions. Such a distal section further has a sleeve diametrically opposed from the flange portion so that a user can offset the distal section from the longitudinal axis and contemporaneously twist the distal section to disengage the flange portion from the notch.

The bristle section further includes a conduit engageable with the proximal section conduit for cooperating therewith to advantageously guide the dentifrice axially through the distal section and towards the head portion. Such a head portion is provided with a plurality of spaced channels extending orthogonally from the distal section conduit and terminating adjacent to the bristles respectively so that dentifrice can effectively be dissipated from the head portion during operating conditions.

The distal portion also includes a power mechanism for vibrating the bristles along a selected path. Such a power mechanism is disposed within the distal section and is advantageously independently operable from the engaging mechanism. The power mechanism includes a motor and an oscillating member operably attached thereto. A power supply source and a switch are electrically coupled thereto so that a user can conveniently selectively activate the power mechanism as desired.

The toothbrush also includes a dispensing mechanism for manually adjusting a volume of the reservoir so that a user can selectively dissipate dentifrice outwardly from the reservoir and head portion as needed. Such a dispensing mechanism is operable when the proximal and distal sections are engaged. The dispensing mechanism includes a gasket intermediately engaged with the lower end portion of the distal section and further includes a snap ring radially disposed about the axis and positioned within the reservoir. The dispensing mechanism and the power mechanism are independently operable.

The dispensing mechanism preferably includes an end cap assembly secured to the bottom end portion of the proximal section. Such an assembly includes threadably engageable male and female portions oriented about the axis. The female portion is disposed distally of the male portion wherein the male portion includes a threaded rod integral therewith and axially extending through the reservoir.

The dispensing mechanism also includes a plunger having a threaded inner surface concentrically engaged about the rod. Such a plunger extends radially outward therefrom so that an outer surface of the plunger maintains continuous contact with an inner surface of the reservoir. The plunger is axially movable along the rod as a user rotates the male member between clockwise and counterclockwise directions to thereby conveniently direct dentifrice distally through the reservoir. The plunger preferably includes an integral rib portion radially extending therefrom. The reservoir further has an elongated sleeve formed therein and extending substantially parallel to the axis. Such a sleeve is spaced from the rod for effectively receiving the rib portion so that the plunger can move distally within the reservoir as a user rotates the male portion.

The dispensing mechanism further includes a conduit in fluid communication with the reservoir extending distally therefrom along a substantially linear path. Such a conduit effectively directs dentifrice outwardly and away from the proximal section.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–6 by the numeral 10 and is intended to provide a power operable dispensing toothbrush. It should be understood that the device 10 may be used to dispense many different types of dentifrice and should not be limited to only one brand.

Figure 1:
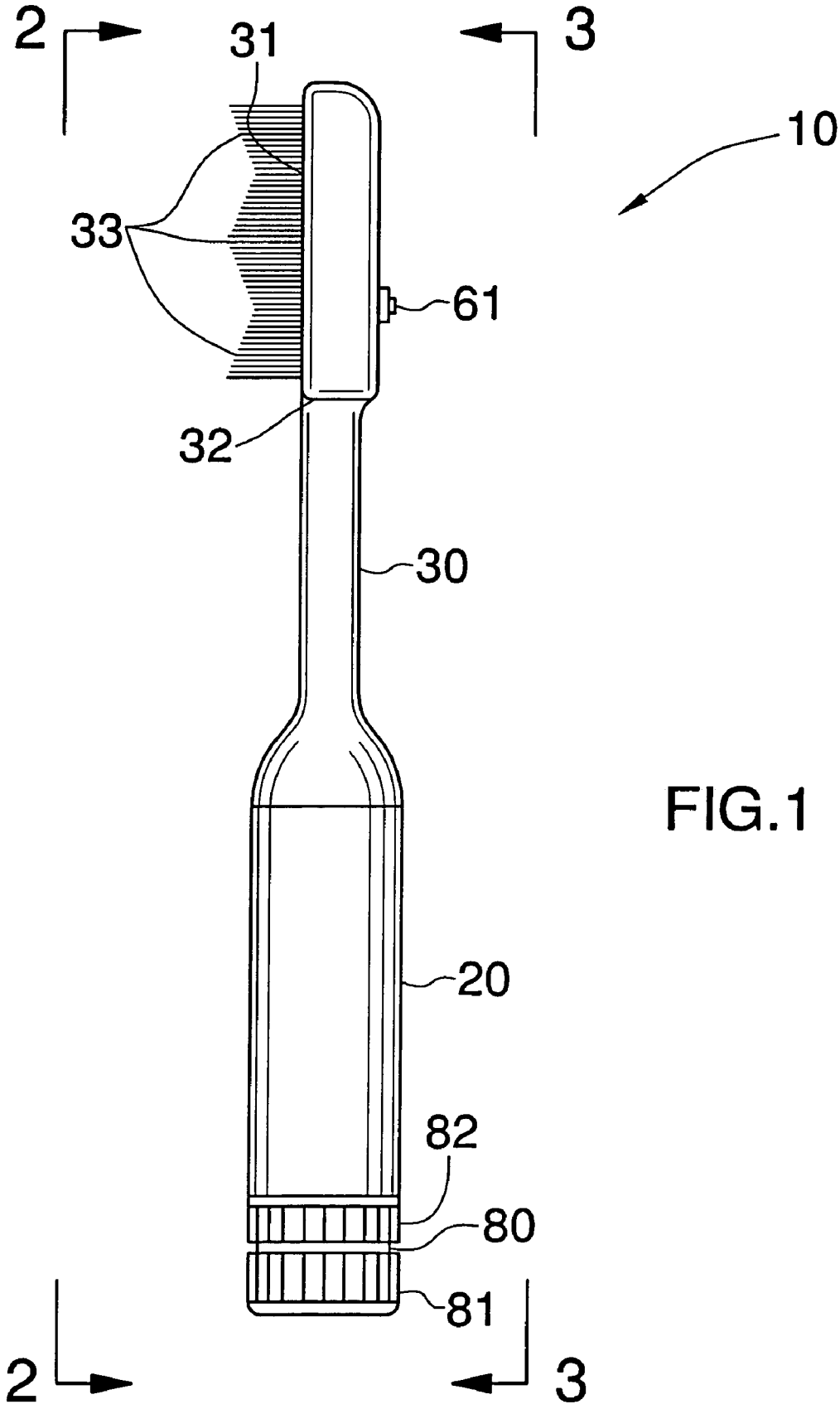
FIG. 1 is a side elevational view showing a power operable dispensing toothbrush for selectively dispensing dentifrice, in accordance with the present invention.
Figure 2:
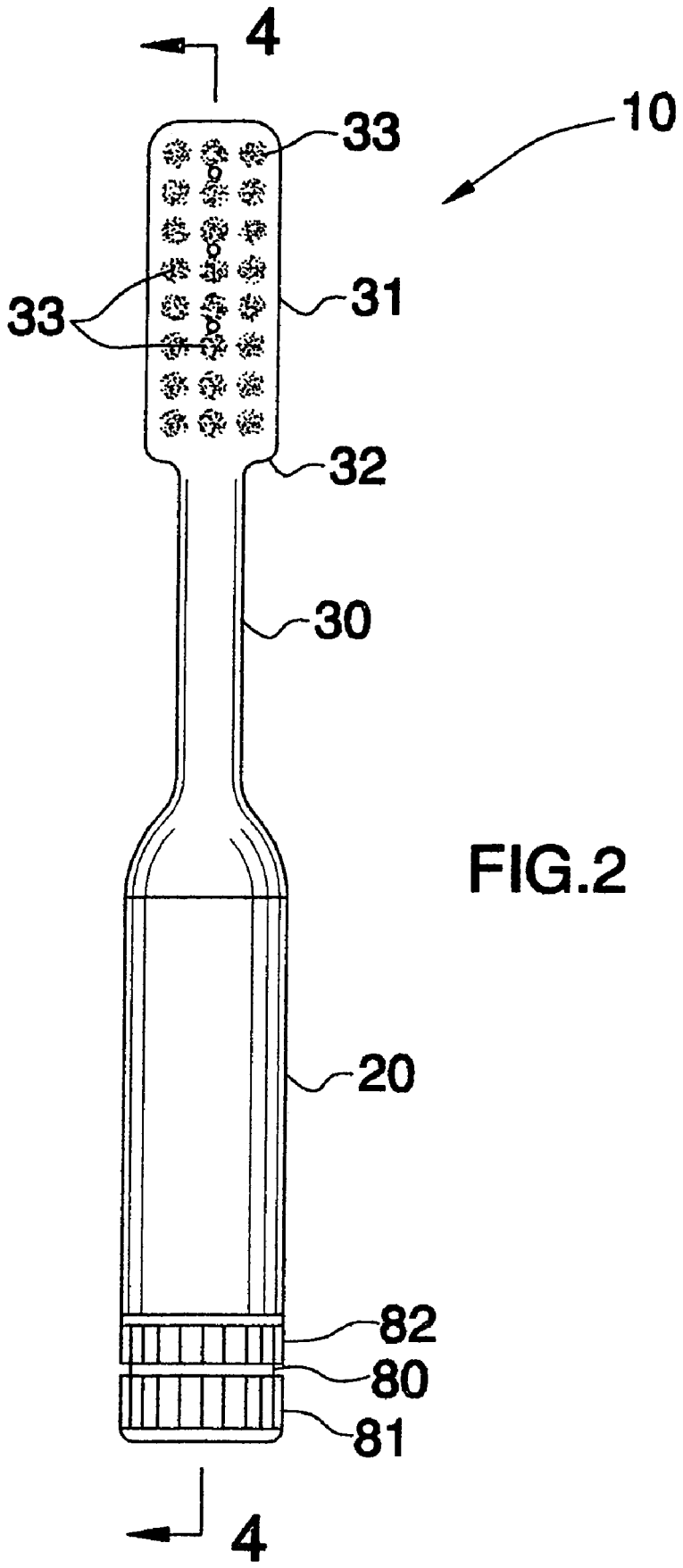
FIG. 2 is a front elevational view of the toothbrush shown in FIG. 1, taken along line 2—2.

Referring initially to FIG. 1, the device 10 includes a proximal section 20 having a centrally disposed longitudinal axis and defining a reservoir 21 axially disposed along a partial length thereof. Such a reservoir 21 has oppositely spaced top 22 and bottom 23 end portions.

The present invention also includes a distal section 30 defining a bristle section 31. The proximal section 20 includes a mechanism 40, shown in FIGS. 3 thru 6, for removably engaging the distal section 30 and a head portion 32 oppositely spaced from the engaging mechanism 40. A plurality of randomly spaced bristles 33 are selectively engageable with a user's teeth (not shown).

Figure 3:
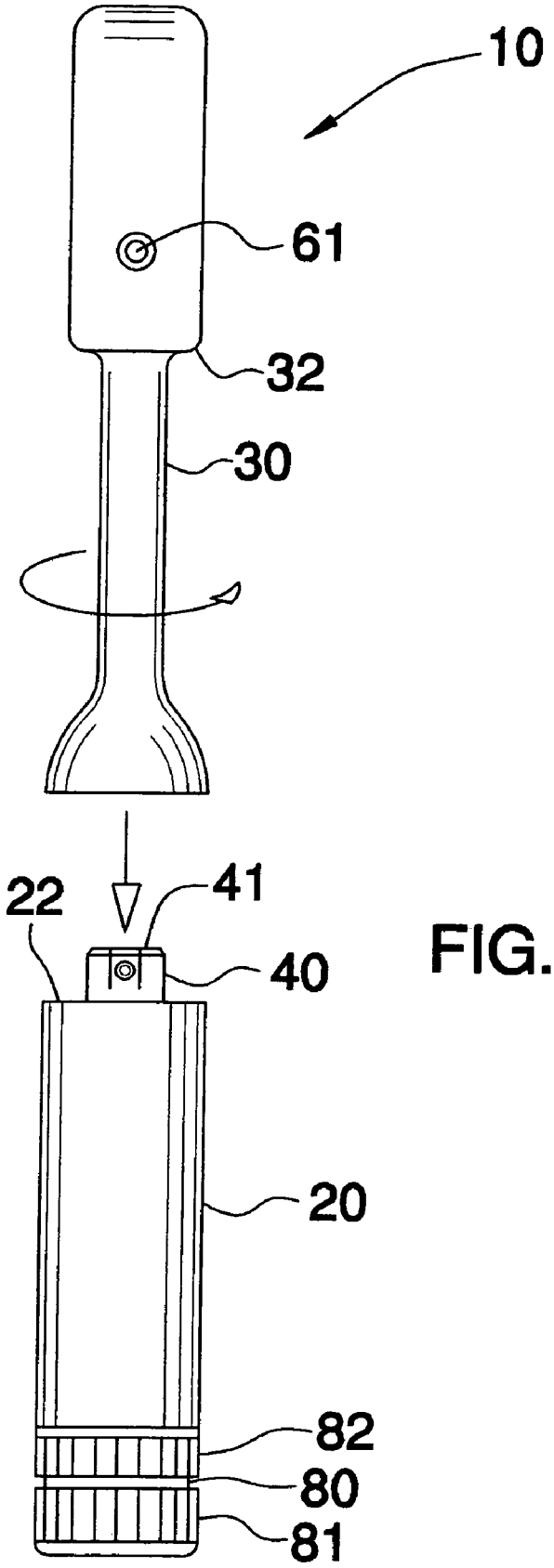
FIG. 3 is a rear elevational view of the apparatus showing the disengaged bristle section, taken along line 3—3.

The engaging mechanism 40 includes a flange portion 41 pivotally connected to the top end portion 22 of the proximal section 20. The distal section 30 is provided with a corresponding notch 34 sized and shaped for receiving the flange portion 41 therein, advantageously maintaining the distal 30 and proximal 20 sections at locked positions. Such a distal section 30 further has a sleeve 35 diametrically opposed from the flange portion 41 so that a user can offset the distal section 30 from the longitudinal axis and contemporaneously twist the distal section 30 to disengage the flange portion 41 from the notch 34, as can be seen in FIG. 3. This feature advantageously allows the bristle section 31 to be replaced when required, extending the functional life of the device 10.

Figure 4:
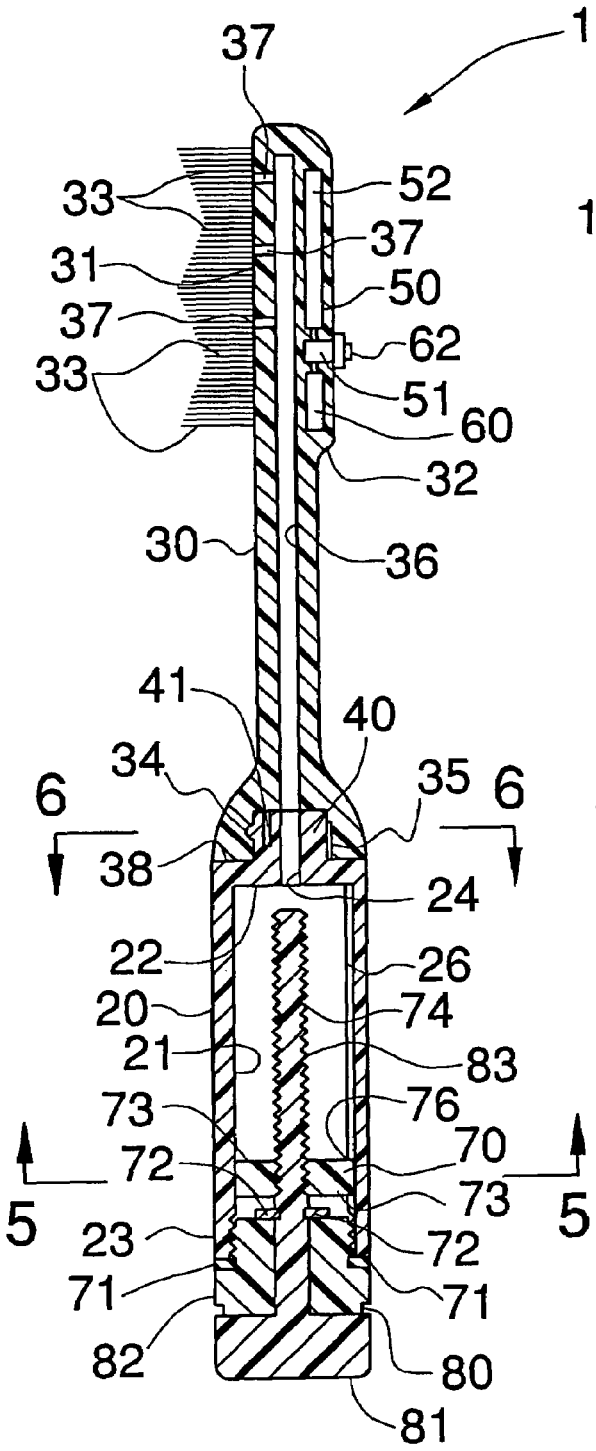
FIG. 4 is a cross-sectional view of the toothbrush shown in FIG. 2, taken along line 4—4.
Figure 6:
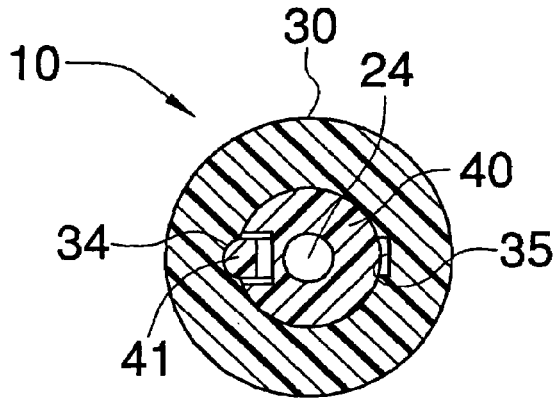
FIG. 6 is a cross-sectional view of the toothbrush shown in FIG. 4, taken along line 6—6.
Figure 5:
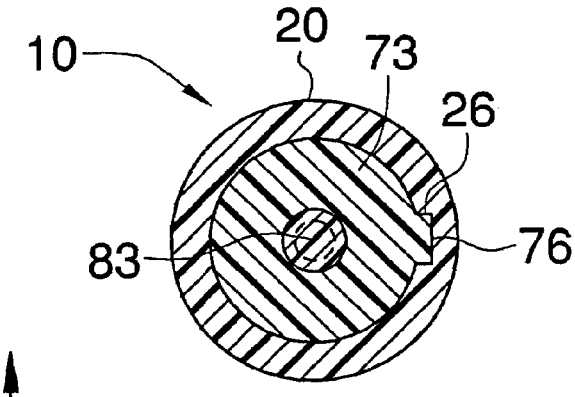
FIG. 5 is a cross-sectional view of the toothbrush shown in FIG. 4, taken along line 5—5.

As shown in FIG. 4, the bristle section 31 further includes a conduit 36 engageable with the proximal section 20 conduit 24 for cooperating therewith to advantageously guide the dentifrice axially through the distal section 30 and towards the head portion 32. Such a head portion 32 is provided with a plurality of spaced channels 37 extending orthogonally from the distal section 30 conduit 36 and terminating adjacent to the bristles 33 respectively so that dentifrice can effectively be dissipated from the head portion 32 during operating conditions. This feature ensures that proper application of dentifrice will occur and prevents dentifrice from disengaging the bristles 33 as often occurs when applied by conventional methods.

The distal portion 30 also includes a power mechanism 50 for vibrating the bristles 33 along a selected path, effectively mimicking the movement of a manually operated toothbrush and thus conveniently cleaning a user's teeth. Such a power mechanism 50 is disposed within the distal section 30 and is advantageously independently operable from the engaging mechanism 40. The power mechanism 50 includes a motor 51 and an oscillating member 52 operably attached thereto. A power supply source 60 and a switch 61 are electrically coupled thereto so that a user can conveniently selectively activate the power mechanism 50 as desired.

The toothbrush 10 also includes a dispensing mechanism 70 for manually adjusting a volume of the reservoir 21 so that a user can selectively dissipate dentifrice outwardly from the reservoir 21 and head portion 32 as needed, thus conveniently eliminating the need for a potentially messy conventional tube of dentifrice. Such a dispensing mechanism 70 is operable when the proximal 20 and distal 30 sections are engaged. The dispensing mechanism 70 includes a gasket 71 intermediately engaged with the lower end portion 38 of the distal section 30 and further includes a snap ring 72 radially disposed about the axis and positioned within the reservoir 21. Such a snap ring conveniently prevents the end cap assembly 80 (described herein below) from disengaging at an undesired time. The dispensing mechanism 70 and the power mechanism 50 are independently operable.

The dispensing mechanism 70 includes an end cap assembly 80 secured to the bottom end portion 23 of the proximal section 20. Such an assembly 80 includes threadably engageable male 81 and female 82 portions oriented about the axis. The female portion 82 is disposed distally of the male portion 81 wherein the male portion 81 includes a threaded rod 83 integral therewith and axially extending through the reservoir 21.

The dispensing mechanism 70 also includes a plunger 73 having a threaded inner surface 74 concentrically engaged about the rod 83. Such a plunger 73 extends radially outward therefrom so that an outer surface 75 of the plunger 73 maintains continuous contact with an inner surface 25 of the reservoir 21, ensuring that all the dentifrice contained in the reservoir 21 is directed outwardly therefrom and into the conduits 24, 36 and towards the bristles 33. The plunger 73 is axially movable along the rod 83 as a user rotates the male member 81 between clockwise and counterclockwise directions to thereby conveniently direct dentifrice distally through the reservoir 21. The plunger 73 includes an integral rib portion 76 radially extending therefrom. The reservoir 21 further has an elongated sleeve 26 formed therein and extending substantially parallel to the axis. Such a sleeve 26 is spaced from the rod 83 for effectively receiving the rib portion 76 so that the plunger 73 can move distally within the reservoir 21 as a user rotates the male portion 81.

The dispensing mechanism 70 further includes a conduit 24 in fluid communication with the reservoir 21 extending distally therefrom along a substantially linear path. Such a conduit 24 effectively directs dentifrice outwardly and away from the proximal section 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hand-operable toothbrush for selectively dispensing dentifrice as desired by a user, said toothbrush comprising:

a proximal section having a centrally disposed longitudinal axis and defining a reservoir axially disposed along a partial length thereof, said reservoir having oppositely spaced top and bottom end portions;

a distal section defining a bristle section and comprising means for removably engaging said proximal section, wherein said engaging means comprises: a flange portion pivotally connected to said top end portion of said proximal section, said distal section being provided with a corresponding notch sized and shaped for receiving said flange portion therein and for maintaining said distal and proximal sections at locked positions, said distal section further having a sleeve diametrically opposed from said flange portion so that the user can offset said distal section from the longitudinal axis and contemporaneously twist said distal section to disengage said flange portion from said notch, a head portion oppositely spaced from said engaging means and including a plurality of randomly spaced bristles selectively engageable with the user's teeth, wherein said bristle section further comprises: a conduit engageable with said proximal section conduit and for cooperating therewith to guide the dentifrice axially through said distal section and towards said head portion, said head portion being provided with a plurality of spaced channels extending orthogonally from said distal section conduit and terminating adjacent said bristles respectively so that dentifrice is dissipated from said head portion during operating conditions, and power means for vibrating said bristles along a selected path, said power means being disposed within said distal section and being independently operable from said engaging means;

dispensing means for manually a volume of said reservoir so that the user selectively dissipates dentifrice outwardly from said reservoir and head portion as needed, said dispensing means being operable when said proximal and distal sections are engaged, wherein said dispensing means comprises: an end cap assembly secured to said bottom end portion of said proximal section, said end cap assembly comprising threadably engageable male and female portions oriented about the axis, said female portion being disposed distally of said male portion wherein said male portion includes a threaded rod integral therewith and axially extending through said reservoir; a plunger having a threaded inner surface concentrically engaged about said rod, said plunger extending radially outward therefrom so that an outer surface of said plunger maintains continuous contact with an inner surface of said reservoir, said plunger being axially movable along said rod as the user rotates said male member between clockwise and counterclockwise directions and to thereby direct dentifrice distally through said reservoir; and a conduit in fluid communication with said reservoir and extending distally therefrom along a substantially linear path, said conduit for directing dentifrice outwardly and away from said proximal section;

wherein said dispensing means and said power means are independently operable.

2. The toothbrush of claim 1, wherein said power means comprises:

a motor and an oscillating member operably attached thereto; and a power supply source and a switch electrically coupled thereto so that a user can selectively activate said power means as desired.

3. The toothbrush of claim 1, wherein said plunger comprises: an integral rib portion radially extending therefrom, said reservoir having an elongated sleeve formed therein and extending substantially parallel to the axis, said sleeve being spaced from said rod and for receiving said rib portion so that said plunger can move distally within said reservoir as a user rotates said male portion.

4. A hand-operable toothbrush for selectively dispensing dentifrice as desired by a user, said toothbrush comprising:

a proximal section having a centrally disposed longitudinal axis and defining a reservoir axially disposed along a partial length thereof, said reservoir having oppositely spaced top and bottom end portions;

a distal section defining a bristle section and comprising means for removably engaging said proximal section, wherein said engaging means comprises: a flange portion pivotally connected to said top end portion of said proximal section, said distal section being provided with a corresponding notch sized and shaped for receiving said flange portion therein and for maintaining said distal and proximal sections at locked positions, said distal section further having a sleeve diametrically opposed from said flange portion so that the user can offset said distal section from the longitudinal axis and contemporaneously twist said distal section to disengage said flange portion from said notch, a head portion oppositely spaced from said engaging means and including a plurality of randomly spaced bristles selectively engageable with the user's teeth, wherein said bristle section further comprises: a conduit engageable with said proximal section conduit and for cooperating therewith to guide the dentifrice axially through said distal section and towards said head portion, said head portion being provided with a plurality of spaced channels extending orthogonally from said distal section conduit and terminating adjacent said bristles respectively so that dentifrice is dissipated from said head portion during operating conditions, and power means for vibrating said bristles along a selected path, said power means being disposed within said distal section and being independently operable from said engaging means;

dispensing means for manually a volume of said reservoir so that a user can selectively dissipate dentifrice outwardly from said reservoir and head portion as needed, said dispensing means being operable when said proximal and distal sections are engaged, said dispensing means comprising a gasket intermediately engaged with said lower end portion of said distal section, wherein said dispensing means comprises: an end cap assembly secured to said bottom end portion of said proximal section, said end cap assembly comprising threadably engageable male and female portions oriented about the axis, said female portion being disposed distally of said male portion wherein said male portion includes a threaded rod integral therewith and axially extending through said reservoir; a plunger having a threaded inner surface concentrically engaged about said rod, said plunger extending radially outward therefrom so that an outer surface of said plunger maintains continuous contact with an inner surface of said reservoir, said plunger being axially movable along said rod as the user rotates said male member between clockwise and counterclockwise directions and to thereby direct dentifrice distally through said reservoir; and a conduit in fluid communication with said reservoir and extending distally therefrom along a substantially linear path, said conduit for directing dentifrice outwardly and away from said proximal section;

wherein said dispensing means and said power means are independently operable.

5. The toothbrush of claim 4, wherein said power means comprises:

a motor and an oscillating member operably attached thereto; and a power supply source and a switch electrically coupled thereto so that a user can selectively activate said power means as desired.

6. The toothbrush of claim 5, wherein said plunger comprises: an integral rib portion radially extending therefrom, said reservoir having an elongated sleeve formed therein and extending substantially parallel to the axis, said sleeve being spaced from said rod and for receiving said rib portion so that said plunger can move distally within said reservoir as a user rotates said male portion.

7. A hand-operable toothbrush for selectively dispensing dentifrice as desired by a user, said toothbrush comprising:

a proximal section having a centrally disposed longitudinal axis and defining a reservoir axially disposed along a partial length thereof, said reservoir having oppositely spaced top and bottom end portions;

a distal section defining a bristle section and comprising means for removably engaging said proximal section, wherein said engaging means comprises: a flange portion pivotally connected to said top end portion of said proximal section, said distal section being provided with a corresponding notch sized and shaped for receiving said flange portion therein and for maintaining said distal and proximal sections at locked positions, said distal section further having a sleeve diametrically opposed from said flange portion so that the user can offset said distal section from the longitudinal axis and contemporaneously twist said distal section to disengage said flange portion from said notch, a head portion oppositely spaced from said engaging means and including a plurality of randomly spaced bristles selectively engageable with the user's teeth, wherein said bristle section further comprises: a conduit engageable with said proximal section conduit and for cooperating therewith to guide the dentifrice axially through said distal section and towards said head portion, said head portion being provided with a plurality of spaced channels extending orthogonally from said distal section conduit and terminating adjacent said bristles respectively so that dentifrice is dissipated from said head portion during operating conditions, and power means for vibrating said bristles along a selected path, said power means being disposed within said distal section and being independently operable from said engaging means;

dispensing means for manually a volume of said reservoir so that the user selectively dissipates dentifrice outwardly from said reservoir and head portion as needed, said dispensing means being operable when said proximal and distal sections are engaged, said dispensing means comprising a gasket intermediately engaged with said lower end portion of said distal section, said dispensing means further comprising a snap ring radially disposed about the axis and being positioned within said reservoir, wherein said dispensing means further comprises: an end cap assembly secured to said bottom end portion of said proximal section, said end cap assembly comprising threadably engageable male and female portions oriented about the axis, said female portion being disposed distally of said male portion wherein said male portion includes a threaded rod integral therewith and axially extending through said reservoir; a plunger having a threaded inner surface concentrically engaged about said rod, said plunger extending radially outward therefrom so that an outer surface of said plunger maintains continuous contact with an inner surface of said reservoir, said plunger being axially movable along said rod as the user rotates said male member between clockwise and counterclockwise directions and to thereby direct dentifrice distally through said reservoir; and a conduit in fluid communication with said reservoir and extending distally therefrom along a substantially linear path, said conduit for directing dentifrice outwardly and away from said proximal section;

wherein said dispensing means and said power means are independently operable.

8. The toothbrush of claim 7, wherein said power means comprises:

a motor and an oscillating member operably attached thereto; and a power supply source and a switch electrically coupled thereto so that a user can selectively activate said power means as desired.

9. The toothbrush of claim 8, wherein said plunger comprises: an integral rib portion radially extending therefrom, said reservoir having an elongated sleeve formed therein and extending substantially parallel to the axis, said sleeve being spaced from said rod and for receiving said rib portion so that said plunger can move distally within said reservoir as a user rotates said male portion.

* * * * *